US011367579B2

(12) United States Patent
Engelhardt et al.

(10) Patent No.: US 11,367,579 B2
(45) Date of Patent: Jun. 21, 2022

(54) METHOD AND APPARATUS FOR CONTROLLING A RELAY

(71) Applicant: E.G.O. Elektro-Geraetebau GmbH, Oberderdingen (DE)

(72) Inventors: Patrick Engelhardt, Oberderdingen (DE); Eduard Kraemer, Bruchsal (DE)

(73) Assignee: E.G.O. Elektro-Geraetebau GmbH, Oberderdingen (DE)

( * ) Notice: Subject to any disclaimer, the term of this patent is extended or adjusted under 35 U.S.C. 154(b) by 0 days.

(21) Appl. No.: 17/140,425

(22) Filed: Jan. 4, 2021

(65) Prior Publication Data

US 2021/0233722 A1 Jul. 29, 2021

(30) Foreign Application Priority Data

Jan. 27, 2020 (DE) ..... 10 2020 200 944.9

(51) Int. Cl.
*H01H 9/56* (2006.01)
*H01H 47/18* (2006.01)

(52) U.S. Cl.
CPC ..... *H01H 9/56* (2013.01); *H01H 47/18* (2013.01); *H01H 2009/566* (2013.01)

(58) Field of Classification Search
CPC ..... H01H 9/56; H01H 2009/566; H01H 47/18
See application file for complete search history.

(56) References Cited

U.S. PATENT DOCUMENTS

2003/0235017 A1* 12/2003 Liu ..... H01H 9/56 361/2
2005/0012505 A1 1/2005 Wilson et al.
2013/0286528 A1* 10/2013 Murfett ..... H01H 9/56 361/195
2015/0098164 A1* 4/2015 Lenig ..... H01H 9/56 361/185
2017/0229269 A1 8/2017 Smith et al.

FOREIGN PATENT DOCUMENTS

DE 19916778 A1 11/2000
DE 102005051762 A1 5/2007
WO WO 2005/074321 A2 8/2005

OTHER PUBLICATIONS

European Patent Office, Extended European Search Report received for Application No. 21152556.3, dated May 31, 2021, 10 pages, Germany.

* cited by examiner

*Primary Examiner* — Thienvu V Tran
*Assistant Examiner* — Bart Iliya
(74) *Attorney, Agent, or Firm* — Alston & Bird LLP

(57) ABSTRACT

In a method for controlling a relay with a relay contact, switching as an opening operation or a closing operation at the relay is temporally captured with respect to accurate opening or closing of the relay contact in comparison with a switching voltage zero crossing of a switching voltage to be switched. An actual switching time is determined and is corrected by means of further capturing of switching operations. A microcontroller is used for this purpose, and the signals can be digitally captured, that is to say at an A/D input.

16 Claims, 3 Drawing Sheets

METHOD AND APPARATUS FOR CONTROLLING A RELAY

CROSS-REFERENCE TO RELATED APPLICATIONS

This application claims priority to German Application No. 10 2020 200 944.9 filed Jan. 27, 2020, the contents of which are hereby incorporated herein in its entirety by reference.

FIELD OF APPLICATION AND PRIOR ART

The invention relates to a method for controlling a relay with a relay contact, preferably a conventional relay. The invention also relates to an apparatus which is designed to carry out this method and has the relay and preferably a load to be connected to a switching voltage by the relay as well as connections to a controller for controlling the relay, which controller preferably has a microcontroller.

DE 19916778 A1 discloses a method for controlling the switching operations of load switches, for example of a contactor. The current flow is monitored in this case.

A further method for establishing a switching connection in an improved manner is known from DE 102005051762 A1. In this case, a switch-on delay and a switch-off delay can be captured.

It is difficult to improve such control of a relay during practical operation with little effort and a high degree of safety during operation.

OBJECT AND ACHIEVEMENT

The invention is based on the object of providing a method mentioned at the outset and an apparatus mentioned at the outset and designed to carry out the method, with which problems in the prior art can be solved and it is possible, in particular, to be able to control a relay safely and reliably and to open or close the relay contact as far as possible at the switching voltage zero crossing, in which case the design effort should preferably remain low.

This object is achieved by means of a method having the features of claim 1 and by means of an apparatus having the features of claim 14. Advantageous and preferred configurations of the invention are the subject matter of the further claims and are explained in more detail below. In this case, some of the features are described only for the method or only for the apparatus. However, irrespective of this, they are intended to be able to apply both to a method and to an apparatus autonomously and independently of one another. The wording of the claims is incorporated in the description by express reference.

For the method, provision is made for the following steps to be carried out. Switching as an opening operation or as a closing operation at the relay is generally temporally captured with respect to accurate opening and accurate closing of the relay contact in comparison with a switching voltage zero crossing of a switching voltage to be switched. The switching voltage to be switched is therefore advantageously monitored and it is likewise monitored whether the relay contact is open or closed. This is determined as stopping or starting of a switching current flow, which is therefore also indirectly captured or monitored by monitoring the voltage change. The period between control of the relay using a switching trigger signal and actual opening or closing of the relay contact is referred to as a switching delay and is captured or determined. It may be a few milliseconds in practice. At a frequency of the switching voltage to be switched of 230 V at 50 Hz as the normal mains frequency, a half-cycle lasts for 10 msec. The switching delay is therefore preferably less than the duration of a half-cycle.

The switching voltage to be switched by the relay is therefore monitored or captured, preferably permanently. After enabling a command to switch, the relay is controlled to switch or to open or close the relay contact using a switching trigger signal. However, the relay is controlled using the switching trigger signal before the or a switching voltage zero crossing, to be precise in a manner moved forward in terms of time by said switching delay or such that it happens earlier than a switching voltage zero crossing in terms of time or follows as the next or subsequent switching voltage zero crossing. If the duration of the switching delay is longer than the duration of a half-cycle, the opening operation or the closing operation is only carried out at the switching voltage zero crossing after next, after the relay has been controlled, with actual opening or closing of the relay contact.

The switching time actually carried out, that is to say when the relay contact is open or closed and the switching current flow is stopped or started, is then captured. The switching voltage zero crossing is additionally captured. The switching time actually carried out and the switching voltage zero crossing are then related to one another and a check is carried out in order to determine whether the actual switching time was effected before or after the switching voltage zero crossing. In this case, a so-called switching difference is determined as the period, wherein the actual switching time was before or after the switching voltage zero crossing by precisely this switching difference or was effected too late or too early. Only if the switching difference were zero and the actual switching time were effected at the same time as the switching voltage zero crossing, would the desired optimum switching be carried out. The switching delay is corrected with this switching difference for subsequent identical switching. Identical switching here means switching-off or switching-on or an opening operation or a closing operation. During the correction, the switching difference is added to the switching delay if the actual switching time was too late by precisely the switching difference or was effected with this duration only after the switching voltage zero crossing. If the actual switching time was before the switching voltage zero crossing or was too early by this duration of the switching difference, the switching difference is subtracted from the switching delay. For the subsequent identical switching, a considerably smaller switching difference or a considerably smaller difference between the actual switching time and the switching voltage zero crossing can then be assumed and are ideally right beside one another.

In the invention, a microcontroller is used to capture the switching or the opening operation and the closing operation and the switching voltage zero crossing. Different values mentioned above can also be stored therein. The signals are advantageously digitally captured at the microcontroller, that is to say at an A/D input, and are converted and/or processed therein.

The invention therefore makes it possible for switching to be carried out as accurately as possible at the switching voltage zero crossing. It is therefore easily possible to adapt to different relays and to a possibly different switching behavior during the opening operation and the closing operation.

In order to protect a relay during switching or its relay contact as far as possible, provision may be advantageously made for the switching difference to be corrected so accurately that switching is carried out in a temporal range of +/−0.4 msec around the switching voltage zero crossing. This is considered to be sufficient to avoid an arc during switching, with the result that a relay contact lasts or can be used for a considerably longer time. This is ensured in said switching range of +/−0.4 msec around the switching voltage zero crossing.

In one advantageous configuration of the invention, resistive loads are switched during switching or in the method. Solely resistive loads are preferably switched since the current and voltage are precisely in phase here. This considerably simplifies the method.

In one configuration of the invention, provision may be made for the possible switching delays to be captured separately. A closing switching delay and an opening switching delay may therefore be determined separately for the closing operation and the opening operation, respectively. These two delays need not necessarily be the same and may differ from one another by up to 50% or up to 70%. The opening operation is generally faster than the closing operation. This is one of the reasons why the two switching delays are captured and used separately.

In the method, after enabling a command to switch or after control using the switching trigger signal, provision may be made for the relay to be controlled in a manner moved forward in terms of time by the switching delay or earlier than a subsequent switching voltage zero crossing by the duration of the switching delay. Switching is therefore carried out within a duration of a half-cycle of the switching voltage and after a last captured switching voltage zero crossing. An alternative calculation may provide for the duration of the switching delay to be subtracted from the duration of a half-cycle and for the relay to be controlled using the switching trigger signal after the switching voltage zero crossing by this difference or switching time, with the result that switching is actually carried out as far as possible at the subsequent switching voltage zero crossing. Ultimately, this is the same.

In one development of the invention, it is advantageously possible for a closing operation and an opening operation to each be carried out alternately at the end of a positive half-cycle and at the end of a negative half-cycle of the switching voltage. This means that the closing operation is respectively carried out alternately after the end of a positive half-cycle and then of a negative half-cycle and then of a positive half-cycle again. The opening operation is likewise respectively carried out alternately after the end of a positive half-cycle and then of a negative half-cycle. This makes it possible to reduce so-called material migration at the relay contact which would permanently damage the relay contact. Each identical closing operation and each identical opening operation are therefore carried out with a directly alternating current direction in each case, thus reducing or avoiding precisely said material migration.

In practice, for a method, after a first operation of switching on an electrical appliance containing the relay, provision may be made for this relay to be switched once in any desired manner at any desired time, in particular precisely once at any desired time. A duration of the switching delay of this relay can therefore be roughly captured as the initial switching delay. During the next operation of switching the relay, generally a closing operation, this initial switching delay is then used as the period for triggering the switching trigger signal at the relay before a switching voltage zero crossing. As explained above, the switching difference is then captured as the temporal difference between the actual switching time and the switching voltage zero crossing. The initial switching delay is therefore corrected, as described above, and a switching delay is obtained and is used instead of the initial switching delay for further operation of the electrical appliance with switching-on of the relay. This corrected switching delay of the relay is then used for a subsequent opening operation of the relay. Since, as has been explained above, the relay contact can be opened and closed at different speeds, a noticeable switching difference between the actual switching time and the switching voltage zero crossing will occur again here. The above-mentioned switching delay is corrected with this switching difference in order to obtain an opening switching delay. During the next operation of switching the relay as a closing operation, that is to say when the relay is intended to be closed, the switching difference is then captured again and the switching delay is corrected with the latter in order to obtain a closing switching delay. The relay can then be controlled further using these two switching delays.

Provision may be made for the switching delay to be corrected only at particular intervals by means of a captured switching difference, for example during every fifth, every tenth or every fiftieth switching operation and not during every switching operation. Alternatively and advantageously, however, the switching delay is corrected for every switching operation or every subsequent opening operation and closing operation of the relay. After being corrected twice or three times, no switching difference or no significant switching difference should actually arise any longer, at least no switching difference above the above-mentioned 0.4 msec. Nevertheless, it is possible under certain circumstances for a switching delay to change somewhat as a result of heating of the relay.

In a possible further configuration of the invention, a switching delay of earlier switching, in particular in the first operating hours of the electrical appliance with the relay therein, can be stored. This is advantageously carried out both for an opening operation and for a closing operation. If currently captured values for the switching delay differ by more than 20%, alternatively by more than 30% or 40%, therefrom, a fault in the relay or in control for the relay is detected. Such a fault can be optically and/or acoustically signaled to an operator. Under certain circumstances, provision may even be made for a closing operation of the relay to be prevented, with the result that it is not switched on at all on the electrical appliance. Such deviation of currently captured values for the switching delay by more than the above-mentioned amount, in particular if the currently captured switching delay accordingly lasts for a longer time, is a strong indication of a fault in the relay with the possible risk of sudden failure, with the result that the relay can no longer open, for example. Therefore, the relay should not be switched on at all.

It is possible for between 1000 and 20,000 measurement points per second to be used as the sampling frequency in the microcontroller. This is preferably between 5000 and 8000 measurement points. This results in measurements being carried out approximately every 150 μsec or every 160 μsec or this interval of time being present between two measurement points. This is well below the above-mentioned 0.4 msec strived for as the desired upper limit for an interval of time to the switching voltage zero crossing. When using the microcontroller, it is possible to carry out digital capture on the sense line of the microcontroller. The microcontroller then controls the relay using the switching trigger signal.

An electrical appliance which is designed to carry out the method is advantageously an electrical household appliance or a cooking appliance. The method is therefore integrated in its controller with a microcontroller, for example in a hob. The method can be advantageously used to switch any type of resistive load, even in a baking oven or for use in industry.

These and further features are clear not only from the claims but also from the description and the drawings, in which case the individual features can each be implemented alone or jointly in the form of a subcombination in one embodiment of the invention and in other fields and may constitute advantageous and inherently protectable embodiments for which protection is claimed here. The subdivision of the application into individual sections and subheadings does not restrict the generality of the statements made under said subheadings.

BRIEF DESCRIPTION OF THE DRAWINGS

Exemplary embodiments of the invention are schematically illustrated in the drawings and are explained in more detail below. In the drawings.

DETAILED DESCRIPTION OF THE EXEMPLARY EMBODIMENTS

Figure 1:
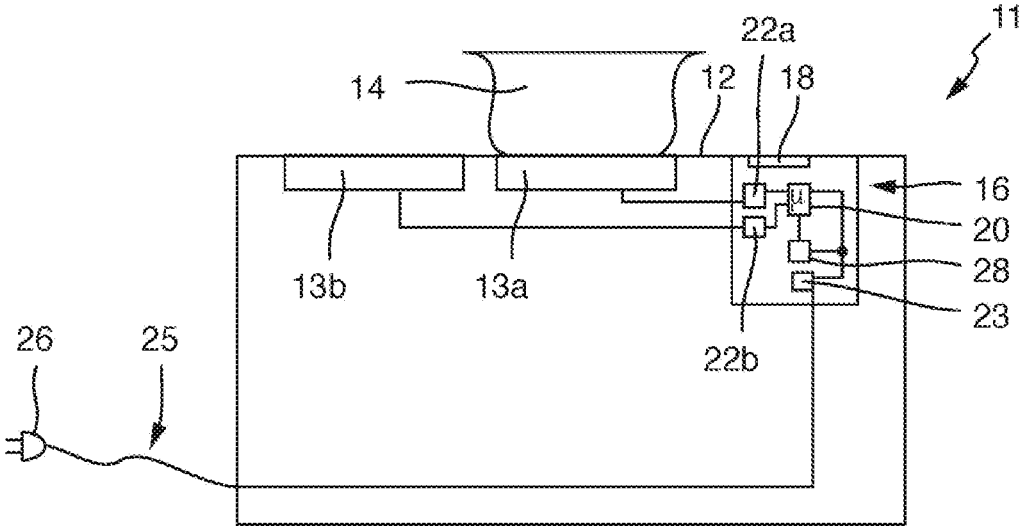
FIG. 1 shows a schematic simplified illustration of a hob for carrying out the method according to the invention with a controller as an apparatus according to the invention.

FIG. 1 illustrates, in a schematic and simplified manner, a hob 11 having a hob plate 12. Two heating devices 13*a* and 13*b*, which here are in the form of known and conventional radiant heating devices, are arranged, by way of example, under the hob plate 12. They are therefore resistance heaters and therefore constitute a solely resistive load. A pot 14 has been placed onto the hob plate 12 above the right-hand heating device 13*a* in order to be heated.

The hob 11 has a controller 16 in order to be operated thereby, in particular in order to supply the heating devices 13*a* and 13*b* with power during operation. The controller 16 has, on the underside of the hob plate 12, an operating device 18, advantageously designed with operating elements in the form of contact switches and displays in the form of LEDs or illuminated displays. The controller 16 also has a microcontroller 20 as so-called intelligence. The microcontroller 20 controls clock relays 22*a* and 22*b* which each switch the switching voltage for the heating devices 13*a* and 13*b* and therefore supply the power. An isolating relay 23 and a switching power supply 28, possibly in the form of a switched-mode power supply, are also provided. For power supply, the controller 16 has a connection cable 25 having a connector 26 at the free end as a mains connection to 230 V/50 Hz. This is representative of the electrical connection of the hob 11, which is normally effected in a connection socket.

Figure 2:
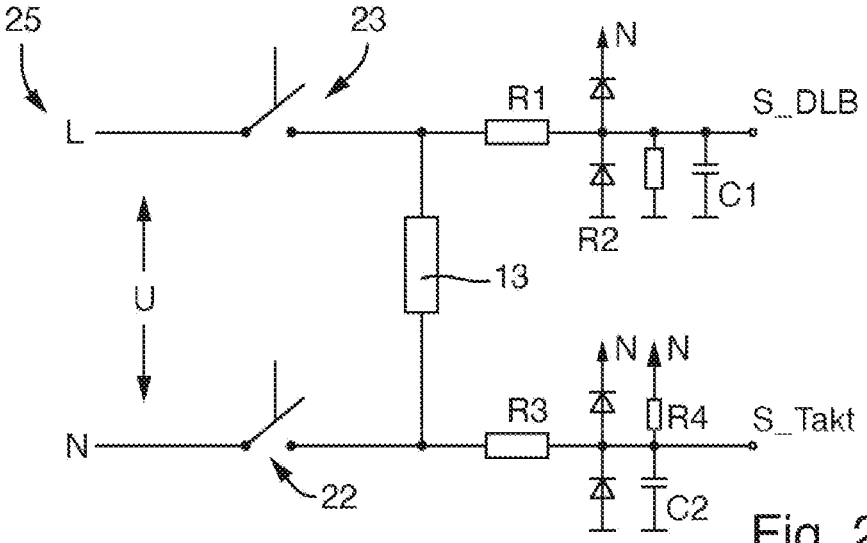
FIG. 2 shows an illustration of circuitry in the controller with a clock relay and an isolating relay.

FIG. 2 illustrates a circuit diagram having a conductor L and a neutral conductor of the switching voltage U, which correspond virtually to the connection cable 25. The conductor L runs to an isolating relay 26 which is substantially used to be opened in emergencies and to switch off the hob 11, for example because a serious fault has been detected. Such a switching operation is very rare. Otherwise, the isolating relay 23 switches only in the current-free state, with the result that its control or switching behavior is not critical for the topic of the present application. In the upper branch, a resistor R1 of upper circuitry is connected to the isolating relay 23. By means of two diodes, the signal downstream of the resistor R1 is between ground and the potential of the neutral conductor N. A further resistor R2 and a capacitance C1 are then connected in parallel with respect to ground. The applied signal S_DLB is needed, in particular for dynamic load balancing.

The clock relay 22 is arranged in the lower branch of the neutral conductor N. A resistor R3 and again diode circuitry are also provided in the lower branch in a similar manner to that in the upper branch. Furthermore, the lower branch is connected to ground by way of a capacitance C2 and is connected to the neutral conductor N or its potential by way of a resistor R4. A signal S_Takt can be tapped off here.

In particular, however, a heating device 13 is connected as a resistive load between the two branches downstream of the clock relay 22 and the isolating relay 23. If both relays 22 and 23 are closed, the heating device 13 is connected to the switching voltage and is operated or heats up thereby. In order to set a particular power in the clock method, as is conventional for radiant heating devices in a hob, the controller 20 controls the clock relay 22 to open and close its relay contact on the basis of a power specification from an operator on the operating device 18 or on the basis of a cooking program. The clock relay 22 therefore switches the switching voltage between L and N. In this case, the isolating relay 23 is always closed. It is opened by the microcontroller 20 only in an above-mentioned serious incident.

Figure 3:
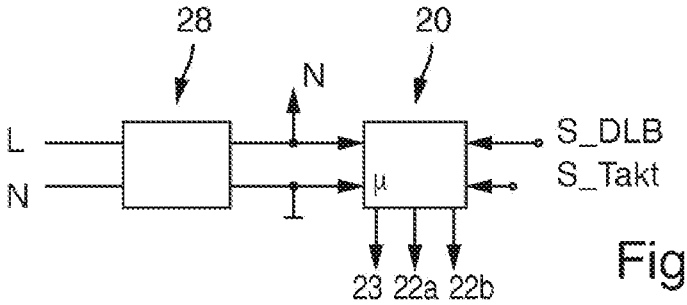
FIG. 3 shows a further part of the circuitry with a connection of the circuit from FIG. 2 to a microcontroller of the controller.

FIG. 3 now illustrates how the switching power supply 28 is likewise connected to the neutral conductor and to the conductor L in accordance with the switching voltage. The switching power supply 28 supplies the microcontroller 20 with a supply voltage in a conventional manner. This voltage can be selected differently, for example may be 3.3 V or 5 V, depending on how the microcontroller 20 is designed. Downstream of the switching power supply, it can be seen that the upper branch is at the potential of the neutral conductor N, while ground with respect to this potential of N is then at −3.3 V or −5 V. Precisely the above-mentioned supply voltage therefore results at the microcontroller 20. This as it were negative ground naturally also applies to the circuitry in FIG. 2. The microcontroller 20 is again connected to the one isolating relay 23 and to the clock relays 22*a* and 22*b* and also to further clock relays if present.

The two signals S_DLB and S_Takt are likewise fed into the microcontroller 20, specifically the signal S_Takt on a digital sense line. The signal S_DLB is also absolutely necessary since it is needed to detect a zero crossing. As is clear from FIG. 2, the signals are used such that the microcontroller 20 for carrying out the method according to the invention can monitor the switching voltage U, on the one hand, and, on the other hand, sees or captures when the clock relay 22 switches and when its actually performed switching time is effected.

Figure 4:
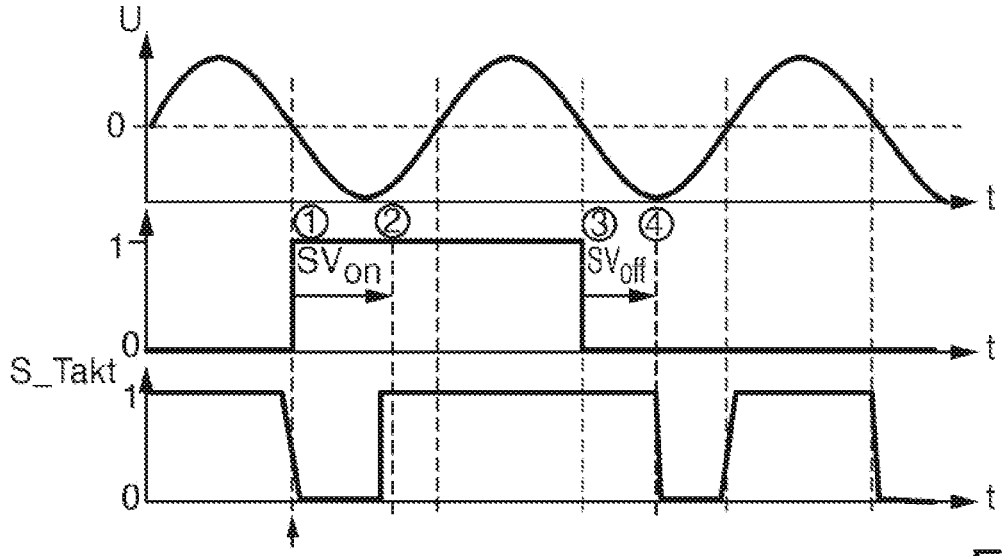
FIG. 4 shows a temporal profile of the switching voltage, of a control signal for one of the relays and of a controlling signal for first determining the switching delays.

FIG. 4 now illustrates, against the time t, the profile for the switching voltage U, the profile for a switching trigger signal underneath and the profile for the signal S_Takt underneath the latter. In this case, the switching voltage U is 230 V at 50 Hz. At the beginning of the method, the microcontroller 20 switches the clock relay 22 at any desired time 1 using a switching trigger signal, with the result that the clock relay closes and a closing operation takes place at its relay contact. After a particular closing switching delay $SV_{on}$, which here may last for 7 msec for example, the clock relay or its relay contact is actually closed and the switching current flow is started. This is then shown in the signal S_Takt if this is specifically at 1 again. It is at zero during the closing operation.

This switching delay $SV_{on}$ is captured by the microcontroller 20 and is stored for use during the next closing operation at the clock relay 22.

At a time which is planned anyway for opening the clock relay 22, for example because this is desired on account of a power level of the power supply for the heating device 13, here time 3, the microcontroller 20 generates a switching trigger signal for opening the clock relay as an opening operation at the relay contact. This is carried out, by way of example, at the zero crossing of the switching voltage, but need not be so. At the time 4, after an opening switching delay $SV_{off}$, the relay contact is then actually open or the switching voltage has been switched and the switching current flow has stopped. This switching delay $SV_{off}$ is approximately 5 msec here and is therefore somewhat shorter than the switching delay during switching-on $SV_{on}$. The microcontroller 20 captures the switching delay $SV_{off}$ of the opening operation. On the one hand, the heating device 13 is now switched off. On the other hand, this can again be detected from the signal S_Takt. This switching delay is stored for next use.

The jump in the signal S_Takt during the actual closing of the clock relay results from the colliding of the relay contact during the closing operation. This is not taken into account.

Figure 5:
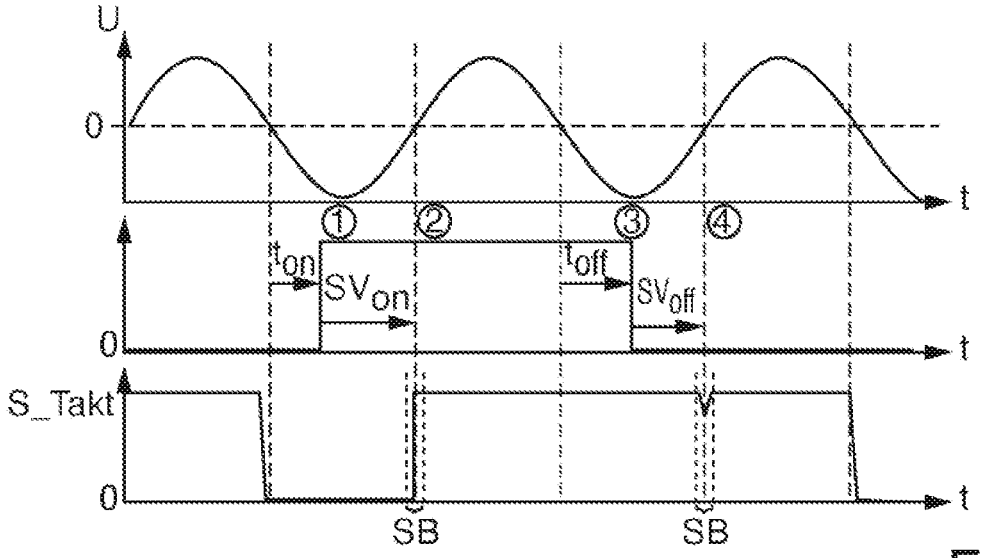
FIG. 5 shows the temporal profile of the switching voltage with use of the determined switching delays in order to carry out switching as far as possible at the switching voltage zero crossing.

FIG. 5 now illustrates how these switching delays are actually used, for example already precisely during the next switching operation at the clock relay. If the heating device is intended to be switched on again for supplying power to said heating device, a switching trigger signal is generated at the clock relay before a zero crossing of the switching voltage, here from negative to positive, in a manner moved forward by the switching delay $SV_{on}$. This can also be easily achieved in practice by virtue of the fact that the microcontroller 20 subtracts this switching delay $SV_{on}$ from the duration of a half-cycle, thus resulting in a switch-on time $t_{on}$. At the oppositely polarized zero crossing of the switching voltage U, the microcontroller 20 therefore waits for this switch-on time $t_{on}$ after the zero crossing from positive to negative in order to then pass the switching trigger signal to the clock relay, that is to say to cause the switching of the latter. This is again the time 1. The clock relay therefore begins the closing operation at the relay contact, which is completed after a particular period which is approximately the above-mentioned switching delay $SV_{on}$. The actual switching time is now detected in the signal S_Takt, specifically if the latter rises again. This is somewhat before the zero crossing illustrated using dashed lines, but is still within the desired switching window SB which may be approximately 800 μsec. The microcontroller 20 here detects this switching difference between the actual switching time and the switching voltage zero crossing, which switching difference may here be 200 μsec, for example. Therefore, although the clock relay has switched in the switching range SB, this is somewhat before the actual switching voltage zero crossing, with the result that the switching delay is corrected. Said switching difference is subtracted from the switching delay $SV_{on}$ and the switching trigger signal for the closing operation is therefore triggered somewhat later the next time or the switch-on time $t_{on}$ becomes accordingly somewhat longer before the switching trigger signal is passed to the clock relay.

After a certain time, the microcontroller 20 is intended to open the clock relay 22 again within the scope of the power supply. A switching trigger signal for the opening operation is therefore intended to be generated before a voltage zero crossing, here from negative to positive, by the switching delay $SV_{off}$ and is intended to be passed to the clock relay 22. For this purpose, the microcontroller 20 subtracts the switching delay $SV_{off}$ from the duration of a half-cycle of the switching voltage and obtains the switch-off time $t_{off}$. After the oppositely polarized switching voltage zero crossing from positive to negative, the process therefore waits for the switch-off time $t_{off}$ and then generates the switching trigger signal for opening the relay contact at the time 3.

After expiry of the switching delay $SV_{off}$ at the time 4, the relay contact is opened or is actually open and the switching current flow stops. This switching can also be detected in the signal S_Takt and it is likewise within the desired switching range SB. However, the actual switching time is somewhat before the switching voltage zero crossing, thus resulting in a switching difference again. This switching difference is subtracted from the switching delay $SV_{off}$ which therefore becomes shorter, with the result that the switching trigger signal is generated somewhat later in the next opening operation or is a shorter length of time before the switching voltage zero crossing and the switch-off time $t_{off}$ becomes somewhat longer as a result. If the actual switching time were somewhat after the switching voltage zero crossing, the resulting switching difference would be added to the switching delay and the switching trigger signal would be generated somewhat earlier in the next opening operation.

The switching delays $SV_{on}$ and $SV_{off}$ corrected in this manner are used during the next closing operation and during the next opening operation. The respective switching difference can then also be captured again and the switching delays $SV_{on}$ and $SV_{off}$ can therefore be corrected again. Furthermore, the microcontroller 20 can take into account the fact that the next closing operation and also the next opening operation are carried out at the oppositely polarized switching voltage zero crossing, that is to say from positive to negative in each case. Switching is then possibly carried out one half-cycle later, but this does not constitute any significant difference or a problem for the power supply.

Figure 6:
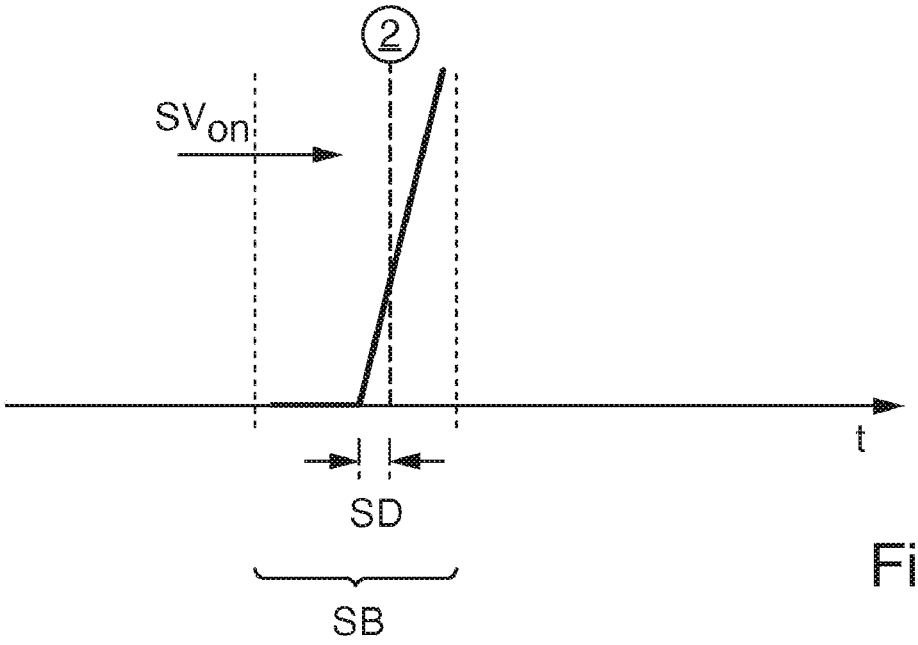
FIG. 6 shows an enlarged illustration of the switching range and the switching difference.

FIG. 6 illustrates, in a greatly enlarged manner according to FIG. 5, how switching is actually carried out after expiry of the switching delay $SV_{on}$ at the time 2. This is carried out somewhat earlier than the switching voltage zero crossing which is illustrated using dashed lines. The switching difference SD may be approximately 100 μec here and is still well within the switching range SB or the actual switching time is within this switching range SB around the switching voltage zero crossing. On account of the actual closing operation which is actually carried out somewhat too early at the relay 22, the illustrated switching difference SD is added to the switching delay $SV_{on}$ as the above-mentioned correction.

The special features of the invention with the simple circuitry according to FIGS. 2 and 3 and the simple control or connection of the microcontroller 20 show how the invention can be advantageously implemented. The connection complexity according to FIG. 2 is low. The above-described continuous correction of the switching delays $SV_{on}$ and $SV_{off}$ ensures an actually performed switching time which is as close as possible to the switching voltage zero crossing, that is to say with a low switching current, at least in the above-mentioned switching range SB of less than 1 msec or less than 0.8 msec.

Furthermore, provision may be made for not only the previous and the new or corrected switching delay but also earlier switching delays to be stored in the microcontroller 20. These switching delays are advantageously stored from the initial activation of the hob 11, with the result that a history of the duration of these switching delays can be captured as it were over a very long period. For this purpose, it may suffice if not every value for switching delays is stored, but rather only every tenth, every fiftieth or every hundredth switching delay, for example. It is then possible to monitor, over a period of several months or even several years of operation of the hob 11, how the switching delay behaves in the long term. It will generally probably increase somewhat. If this increase becomes too great or the speed of the increase increases too greatly, however, for example exceeds certain predefined limit values, the controller 16 or the microcontroller 20 can generate a type of warning or a request to replace a particular clock relay.

The invention claimed is:

1. A method for controlling a relay, said relay having a relay contact, the method comprising the steps of:

switching as an opening operation or as a closing operation at said relay is temporally captured with respect to an accurate opening or an accurate closing of said relay contact in comparison with a switching voltage zero crossing of a switching voltage to be switched, determining a period between control of said relay using a switching trigger signal and an actual opening or an actual closing of said relay contact with stopping or starting of a switching current flow as a switching delay, monitoring said switching voltage to be switched by said relay, after enabling a command to switch, controlling said relay to switch using said switching trigger signal in a manner moved forward in terms of time by said switching delay before a subsequent switching voltage zero crossing, capturing an actual switching time carried out in addition to said switching voltage zero crossing, conducting a check to determine whether said actual switching time was too late or too early by a switching difference relative to said switching voltage zero crossing, wherein said switching delay is corrected with said switching difference for subsequent identical switching:

by adding said switching difference to said switching delay if said actual switching time was too late by said switching difference relative to said switching voltage zero crossing, or by subtracting said switching difference from said switching delay if said actual switching time was too early by said switching difference relative to said switching voltage zero crossing, wherein:

a microcontroller is used to capture said switching or said opening operation and said closing operation and said switching voltage zero crossing; and said opening operation and said closing operation are each alternatively conducted at an end of a positive half-cycle and at an end of a negative half-cycle of said switching voltage, such that the opening operation is carried out alternatively and continuously after the end of the positive half-cycle, then after the end of the negative half-cycle, and then again after an end of another positive half-cycle in a repetitive manner, and such that the closing operation is carried out alternately and continuously after the end of the positive half-cycle, and then after the end of the negative half-cycle, and then after the end of the another positive half-cycle in a repetitive manner.

2. The method as claimed in claim 1, wherein said switching is carried out in a temporal range of +/−0.4 ms around said switching voltage zero crossing.

3. The method as claimed in claim 1, wherein resistive loads are switched during said switching.

4. The method as claimed in claim 3, wherein solely resistive loads are switched during said switching.

5. The method as claimed in claim 1, wherein a closing switching delay and an opening switching delay are determined separately for said closing operation and said opening operation, respectively.

6. The method as claimed in claim 1, wherein, after enabling a command to switch, said relay is controlled to switch, in a manner moved forward in terms of time by said switching delay before a subsequent switching voltage zero crossing, within a duration of a half-cycle of said switching voltage and after a last captured switching voltage zero crossing.

7. The method as claimed in claim 1, wherein, after a first operation of switching on an electrical appliance with said relay therein, said relay is switched once in any desired manner at any desired time in order to roughly capture a duration of said switching delay as an initial switching delay, wherein, when first switching said relay, said initial switching delay is then used as period for controlling said relay with said switching trigger signal before a switching voltage zero crossing, wherein said switching delay is then captured and is further used instead of said initial switching delay for further operation of said electrical appliance with switching of said relay.

8. The method as claimed in claim 1, wherein said switching delay is corrected for each subsequent switching operation or each subsequent opening operation and closing operation.

9. The method as claimed in claim 1, wherein a switching delay of an earlier switching is stored, and, if currently captured values for said switching delay differ by more than 20% from said switching delay of an earlier switching, a fault in said relay or in control for said relay is detected and is signaled to an operator.

10. The method as claimed in claim 9, wherein said switching delay of said earlier switching is stored both for an opening operation and for a closing operation.

11. The method as claimed in claim 9, wherein said closing operation of said relay as a switching-on operation is prevented and is not carried out.

12. The method as claimed in claim 1, wherein between 1000 and 20,000 measurement points per second are used as a sampling frequency for said microcontroller.

13. An apparatus configured to implement the method of claim 1, said apparatus comprising:

a relay with a relay contact, a load to be connected to a switching voltage by said relay, connections to a controller for controlling said relay, a microcontroller which is connected to signal inputs having a signal corresponding to said switching voltage and a signal corresponding to said actual opening or said actual closing of said relay contact, wherein the microcontroller is configured to control said opening operation and said closing operation in said repetitive, continuous, and alternative manner.

14. The apparatus as claimed in claim 13, wherein said apparatus is integrated in an electrical household appliance or in a cooking appliance.

15. The apparatus as claimed in claim 14, wherein said apparatus is integrated in a controller for said electrical household appliance or said cooking appliance.

16. The apparatus as claimed in claim 14, wherein said load is a resistive load.

* * * * *